US011913246B2

(12) United States Patent
Wang

(10) Patent No.: US 11,913,246 B2
(45) Date of Patent: Feb. 27, 2024

(54) POST AND CAP FOR CHAIN LINK FENCE WITH ENHANCED ENGAGEMENT

(71) Applicant: MAT HOLDINGS, INC., Long Grove, IL (US)

(72) Inventor: Steve Wang, Long Grove, IL (US)

(73) Assignee: MAT HOLDINGS, INC., Long Grove, IL (US)

( * ) Notice: Subject to any disclaimer, the term of this patent is extended or adjusted under 35 U.S.C. 154(b) by 78 days.

(21) Appl. No.: 17/644,672

(22) Filed: Dec. 16, 2021

(65) Prior Publication Data

US 2022/0106809 A1 Apr. 7, 2022

Related U.S. Application Data

(62) Division of application No. 16/429,957, filed on Jun. 3, 2019, now Pat. No. 11,274,466.

(60) Provisional application No. 62/689,360, filed on Jun. 25, 2018.

(51) Int. Cl.

| | |
|---|---|
| ***E04H 17/20*** | (2006.01) |
| ***E04H 17/00*** | (2006.01) |
| ***E04H 17/06*** | (2006.01) |

(52) U.S. Cl.

CPC ..... *E04H 17/006* (2021.01); *E04H 17/06* (2013.01)

(58) Field of Classification Search

CPC ..... E04H 17/006; E04H 17/10

See application file for complete search history.

(56) References Cited

U.S. PATENT DOCUMENTS

| | | | | |
|---|---|---|---|---|
| 1,444,834 | A | 2/1923 | Hindmarsh | |
| 1,765,651 | A * | 6/1930 | Bryant | E04H 17/1413 403/333 |
| 1,839,898 | A * | 1/1932 | Skinner | E04H 17/24 256/11 |
| 1,853,945 | A | 4/1932 | Unke | |
| 1,875,137 | A | 4/1932 | Pollock | |
| 3,785,682 | A | 1/1974 | Schaller et al. | |
| 4,492,364 | A | 1/1985 | Boyanton | |
| 5,141,207 | A * | 8/1992 | Meglino | E04F 11/18 256/33 |
| 5,299,883 | A | 4/1994 | Arth, Jr. | |
| 5,421,556 | A | 6/1995 | Dodge et al. | |
| 6,021,614 | A | 2/2000 | Krieger | |
| 6,076,807 | A * | 6/2000 | Spence | E04H 17/1413 256/19 |
| D654,384 | S | 2/2012 | McDonald | |
| 8,844,907 | B1 | 9/2014 | Davis et al. | |

(Continued)

OTHER PUBLICATIONS

Midwest Air Technologies, Inc., "Chain Link Fencing Products", 2007 Product Catalog (Cover Only).

(Continued)

*Primary Examiner* — Joshua T Kennedy

(74) *Attorney, Agent, or Firm* — Greer, Burns & Crain, Ltd

(57) ABSTRACT

A post and cap assembly for chain link fence is provided, including a tubular post with an upper end, an outer surface and an inner surface. A cap is dimensioned for telescoping engagement with the upper end, the cap having an exterior surface, an interior surface and a depending skirt. At least one depending formation extends from the interior surface for engaging the post upper end, as the skirt engages the outer surface.

11 Claims, 5 Drawing Sheets

(56) References Cited

U.S. PATENT DOCUMENTS

| | | | | |
|---|---|---|---|---|
| 2002/0125468 | A1* | 9/2002 | Fischer | E04H 17/006 256/19 |
| 2003/0168649 | A1 | 9/2003 | Weese | |
| 2005/0035339 | A1* | 2/2005 | Steffes | E04H 17/006 256/1 |
| 2005/0092976 | A1* | 5/2005 | Steffes | E04H 17/1426 256/1 |
| 2011/0180773 | A1* | 7/2011 | Pacheco | E04H 17/006 72/347 |
| 2019/0085591 | A1* | 3/2019 | Zhu | E04H 17/006 |
| 2022/0090409 | A1* | 3/2022 | Miller | E04H 17/1482 |

OTHER PUBLICATIONS

Midwest Air Technologies, Inc., "YardGard Chain Link Fencing Products (with QR code)", 2016 Product Catalog, pp. 2,3, 6-9.

* cited by examiner

FIG. 11
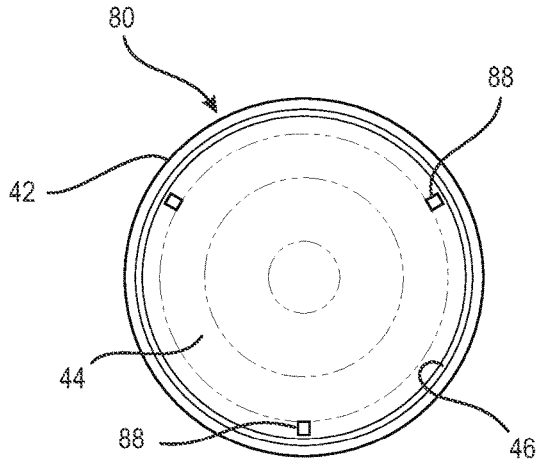
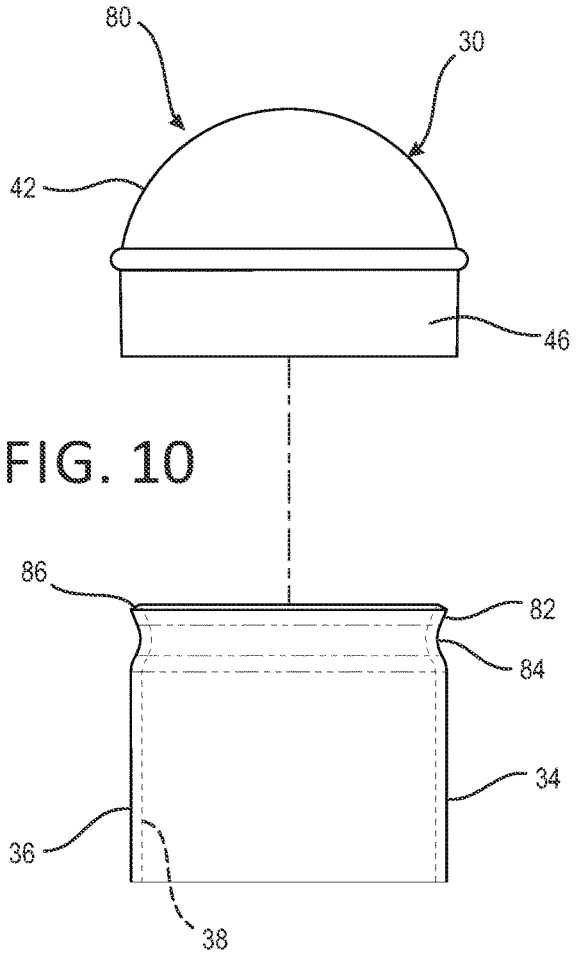
FIG. 10
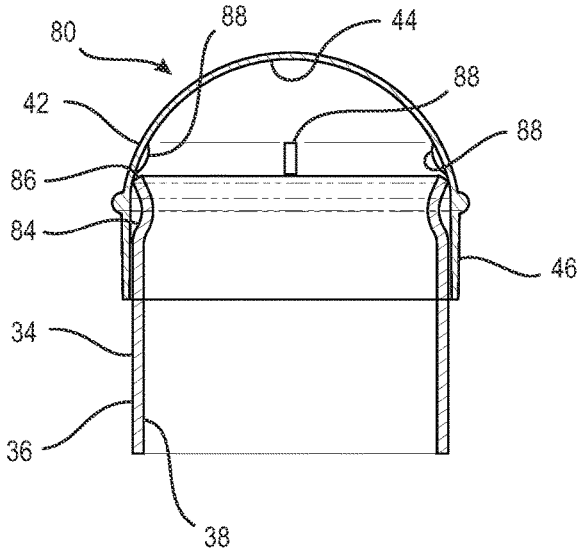
FIG. 12

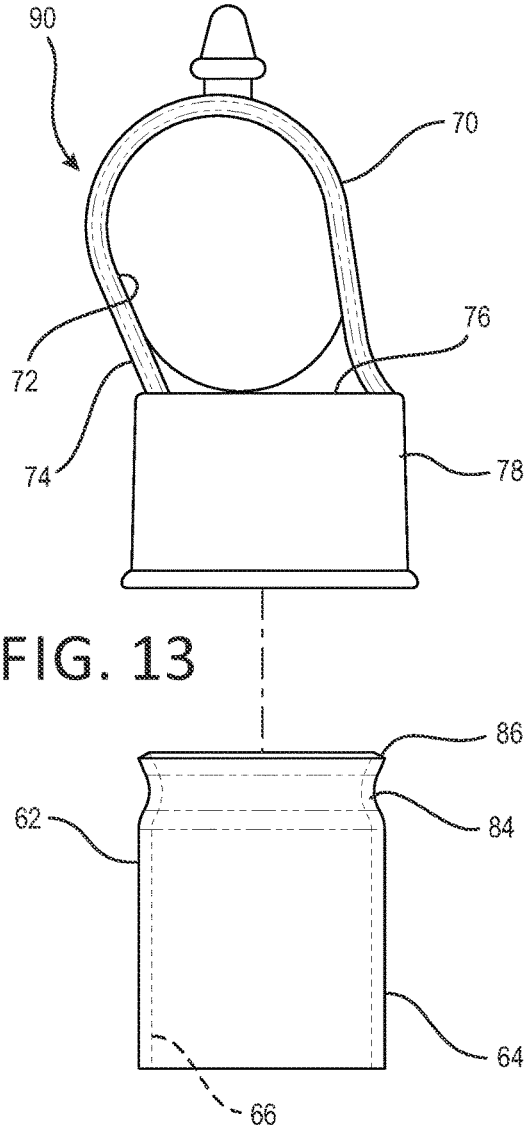
FIG. 13
FIG. 14
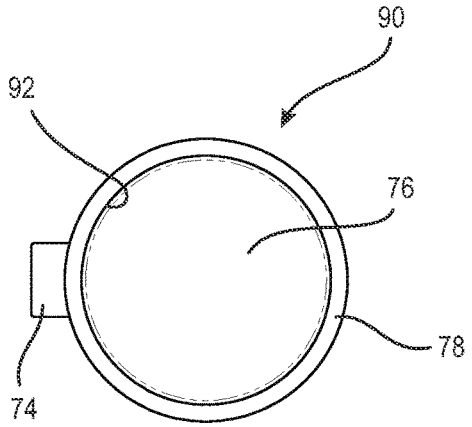
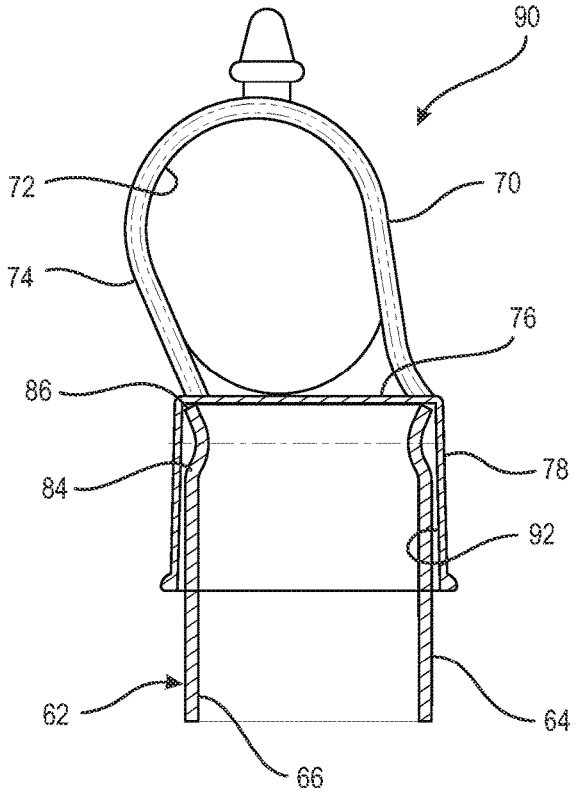
FIG. 15

POST AND CAP FOR CHAIN LINK FENCE WITH ENHANCED ENGAGEMENT

RELATED APPLICATION

This application is a Divisional of U.S. Non-Provisional patent application Ser. No. 16/429,957 filed Jun. 3, 2019, and claims 35 USC 119 priority from U.S. Provisional Ser. No. 62/689,360 filed Jun. 25, 2018, the contents of which are incorporated by reference herein.

BACKGROUND

The present invention relates generally to the construction of chain link fencing, and more specifically to the engagement between caps and posts of such fencing.

Chain link fencing is well known in the art, including a framework made of terminal posts located at corners or ends of the span of fence, intermediate line posts and a top rail connecting the line posts to each other by passing through eye top caps. A woven metal wire fabric is secured to the frame using associated clips or bent wire segments. It is common for terminal posts to be of a larger diameter and in some cases greater thickness of material as compared to line posts, which in turn tend to be larger diameter and greater thickness than the top rails. Caps are positioned on the upper ends of the posts. Terminal posts usually have domed caps, and line posts usually have eye top caps. Since they need to be aligned to slidingly accommodate the top rail, the eye top caps are customarily pivotable about the tops of the line posts.

Often the caps have internal bosses or lugs for enhancing friction with the complementary exterior surface of the posts. The posts are typically made of galvanized steel, and the caps and other fittings are customarily made of cast aluminum.

A common problem of conventional chain link fencing is that variations in manufacturing tolerances, and/or installers use of components from different manufacturers results in a loose fitting between the caps and the respective posts, which tend to rattle or move relative to each other, especially during high wind conditions.

Thus, there is a need for a chain link fencing system where the components are more securely held together to better withstand the above-identified weather conditions and to provide a more secure assembled fence.

SUMMARY

The above-listed need is met or exceeded by the present post and cap for chain link fence with enhanced engagement. The caps, including both terminal caps and eye top caps, are provided with depending gripping formations which are dimensioned to engage the respective post on an inner surface. In addition, upper ends of the posts are crimped or chamfered to enhance the gripping engagement with the cap. In one embodiment, the post upper end presents a narrowed diameter. As such, the caps can be more deeply engaged than in prior fence systems, increasing the frictional contact between the cap and the post for a more positive, tighter fit. In other embodiments, the post upper end is provided with an annular groove spaced slightly away from the post edge or margin, which then flares out slightly to slightly increase the diameter of the post for a tighter fit with the cap, and/or creates an angled or inclined surface that more positively engages depending lugs on an underside of the cap. Any conventional friction-enhancing features on the cap interior that engage the outer surface of the post are also provided.

More specifically, a post and cap assembly for chain link fence is provided, including a tubular post with an upper end, an outer surface and an inner surface. A cap is dimensioned for telescoping engagement with the upper end, the cap having an exterior surface, an interior surface and a depending skirt. At least one depending formation extends from the interior surface for engaging the post upper end, as the skirt engages the outer surface.

In one embodiment, the upper end of the tubular post is crimped, and each depending tab has a tip engaging the crimped end on the inner surface. Also, it is preferred that there is a pair of the depending tabs located diametrically opposite each other. Each depending tab is generally triangular in shape, and has a pointed tip at a free end.

In another embodiment an upper end of the tubular post is crimped to have an annular groove creating an outwardly flared upper post edge, and each depending formation in the cap is a lug constructed and arranged for being engaged by said flared upper post edge. More preferably, three of the depending lugs are provided, being generally peripherally equally spaced on the cap interior surface.

When the cap is a terminal cap, it has a domed portion, and the at least one tab depends from the domed portion. When the cap is a line post cap, the tabs depend from a top end of the cap.

In another embodiment, a post and cap assembly for chain link fence, is provided, including a tubular post with an upper end, an outer surface and an inner surface, the upper end of the tubular post is crimped to include an annular groove with an outwardly flared edge. A cap is dimensioned for telescoping engagement with the upper end, the cap having and exterior surface, and interior surface and a depending skirt. The flared edge tightly engages the interior surface of the cap.

In still another embodiment, a post and cap assembly for chain link fence is provided including a tubular post with an upper end, and outer surface and an inner surface, the upper end of the tubular post is crimped, a cap dimensioned for telescoping engagement with the upper end, the cap having and exterior surface, an interior surface and a depending skirt, and at least one depending tab extending from the interior surface for engaging the inner surface as the skirt engages the outer surface. A pair of the depending tabs is located diametrically opposite each other, each depending tab is generally triangular in shape, and has a pointed tip at a free end, the pointed tip engaging the inner surface at the crimped end.

BRIEF DESCRIPTION OF THE DRAWINGS

FIG. 10 is an exploded front view of an alternate embodiment of the present post and cap;

FIG. 11 is a bottom view of the cap of FIG. 10;

FIG. 12 is a vertical cross-section of the assembled cap and post of FIG. 10;

FIG. 13 is an exploded front view of an alternate embodiment of the present eye top cap and post;

FIG. 14 is a bottom view of the cap of FIG. 13; and

FIG. 15 is a vertical cross-section of the assembled eye top cap and post of FIG. 13.

DETAILED DESCRIPTION

Figure 1:
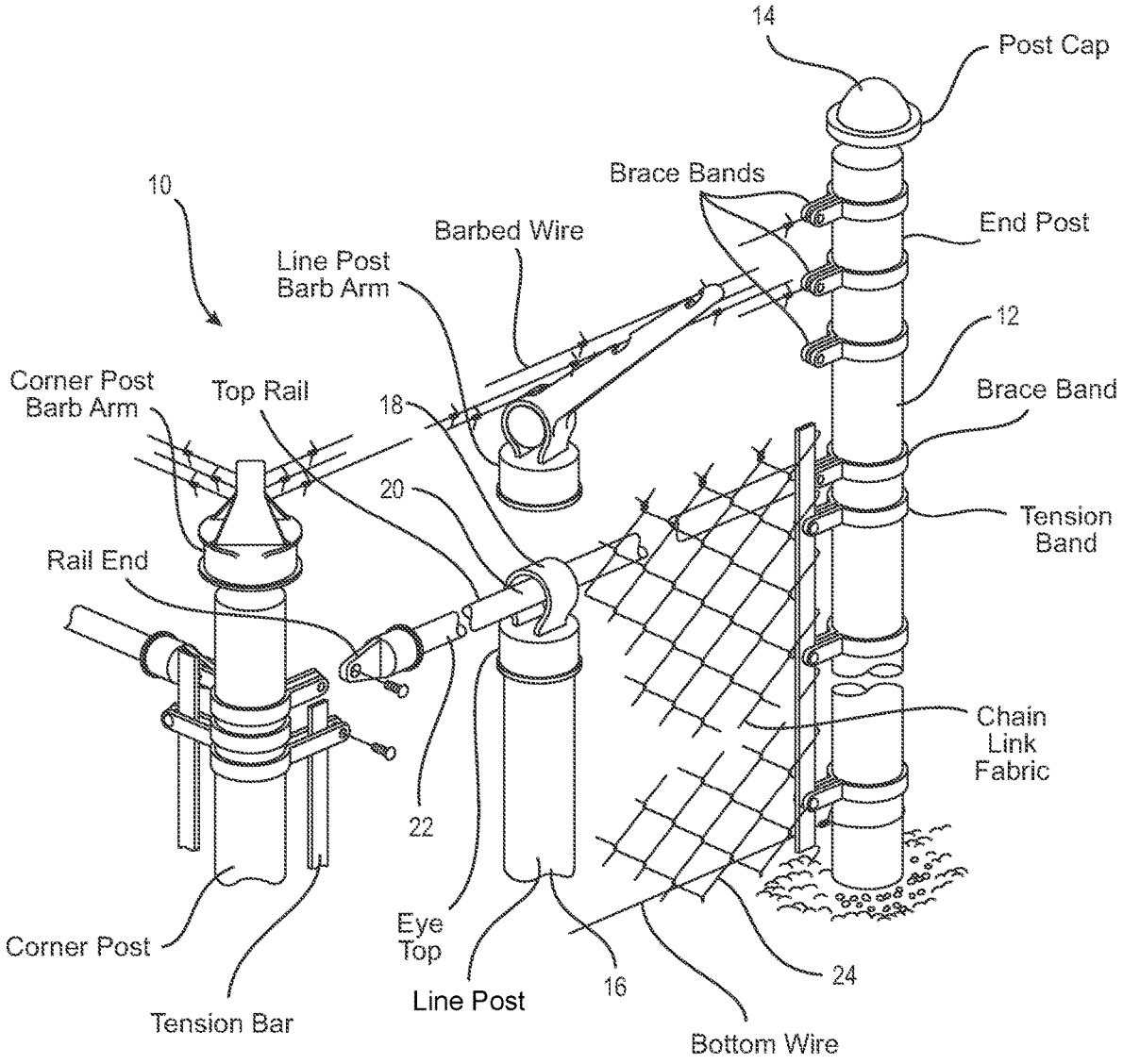
FIG. 1 Prior Art
FIG. 1 is a prior art schematic of a conventional chain link fence assembly.

Referring now to FIG. 1, a conventional chain link fence, generally designated 10, includes a terminal post 12 with a post cap 14, typically located at corners or ends of spans of fence. Between the terminal posts 12 are located several line posts 16 in spaced, parallel arrangement relative to the terminal posts. The spacing between the line posts 16 ranges from 5-10 feet. Each line post 16 is provide with an eye top cap 18 defining an opening 20. A top rail 22 is inserted through the respective openings 20 and provides support for the woven steel wire chain link fabric 24. In conventional assemblies, the top rail 22 has a diameter of 1⅜ inch.

Figure 2:
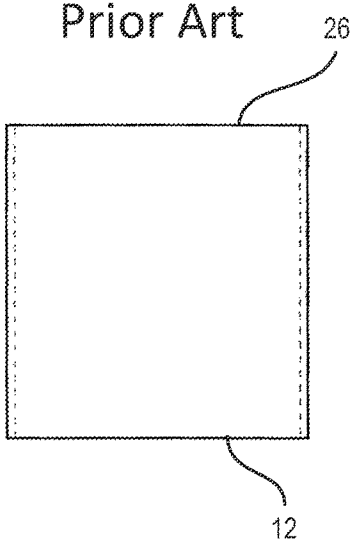
FIG. 2 Prior Art
FIG. 2 is a front view of a prior art chain link terminal fence post.

As seen in FIG. 2, the terminal post 12 has an upper end 26 that conventionally receives the terminal post cap 14. As mentioned above, it has been found that it is common for terminal post caps 14 to be loosely held on the terminal posts due to variations in manufacturing tolerances, and also due to installers using components from various manufacturers. It is common for terminal posts 12 to have a uniform exterior diameter (OD) of 2⅜ inches.

Figure 4:
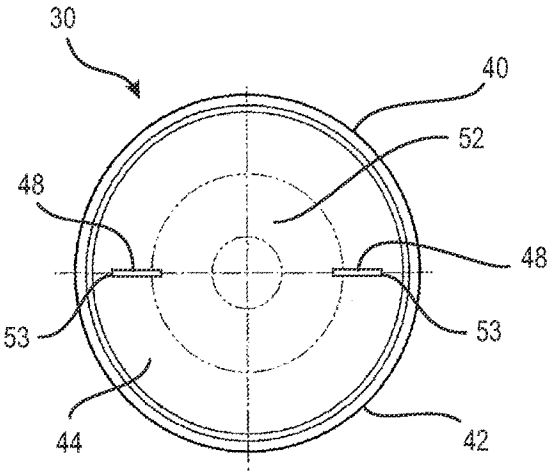
FIG. 4 is a bottom view of the cap of FIG. 3.
Figure 5:
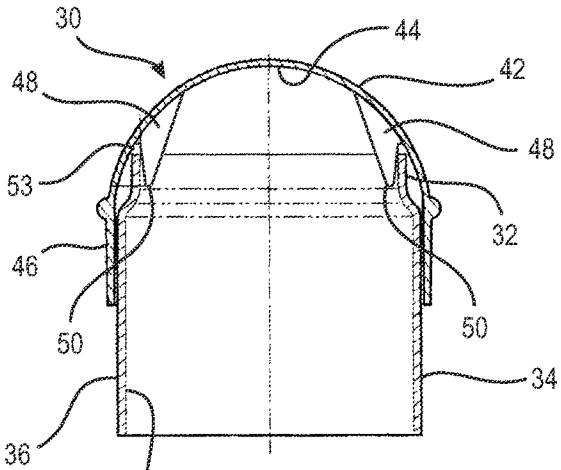
FIG. 5 is a vertical cross-section of the installed cap and post of FIG. 3.
Figure 3:
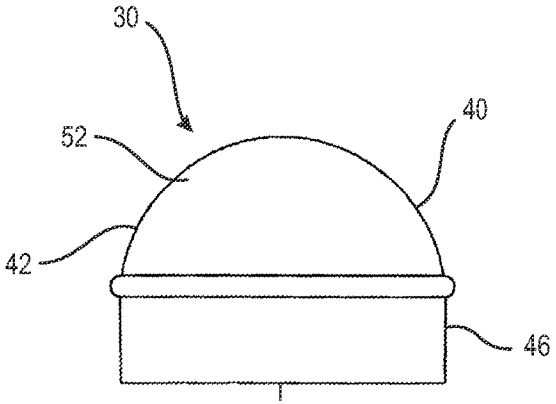
FIG. 3 is an exploded front view of the present chain link terminal fence post and cap combination.
Figure 3:
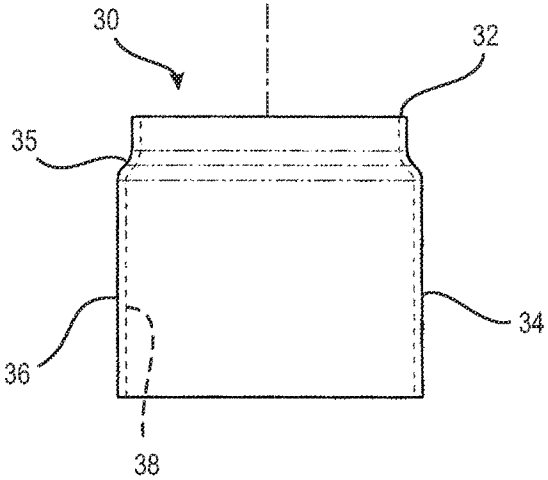

Referring now to FIGS. 3-5, the present chain link fence assembly is generally designated 30. A feature of the assembly 30 is that the upper end 32 of a tubular terminal post 34 is crimped or chamfered to have a reduced diameter. A shoulder 35 is thus defined by the reduced diameter. In addition, the terminal post 34 has an outer surface 36 and an inner surface 38. A terminal post cap 40 is dimensioned for telescoping engagement with the upper end 32 and partially covers the outer surface 36. The cap 40 has an exterior surface 42, an interior surface 44 and a depending annular skirt 46. Another feature of the assembly 30 is at least one depending tab 48 extending from the interior surface 44 for engaging the inner surface 38 of the terminal post 34, as the skirt 46 engages the outer surface 36.

As is known in the art, the terminal post cap 40 is preferably made of cast aluminum or the like, and preferably there is a pair of depending formations 48, here preferably tabs located diametrically opposite each other, and in some embodiments four such tabs. Each tab 48 is preferably generally triangular in shape, however other shapes are contemplated, and includes a tip 50 at a free end pointing away from a domed portion 52 of the terminal post cap 40 from which the tab depends. In addition, each tab 48 has an edge 53 is constructed and arranged for engaging the crimped upper end 32 on the inner surface 38 (FIG. 5). As such, a relatively tight friction fit is achieved.

Also, in view of the preferably crimped upper post end 32, the post 34 extends farther into the domed portion 52 than in conventional fence assemblies 10, also resulting in the cap skirt 46 extending farther down the outer surface 36 of the terminal post 34. The post 34 extends into the terminal post cap 50 approximately 1¼ inch, which is about ½ inch farther than conventional assemblies. It is also contemplated that, in addition to the depending tabs 48, the cap interior surface 44 is provided with conventional friction enhancing surfaces known in the art.

Figure 6:
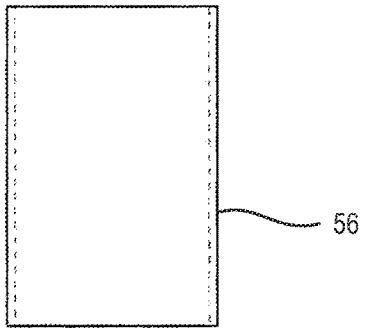
FIG. 6 Prior Art
FIG. 6 is a front view of a prior art chain link line fence post.

Referring now to FIG. 6, a prior art chain link fence line post is designated 54. Such posts have an exterior diameter of approximately 1⅝ inches as is well known in the art. As is the case with the terminal post 12 of FIG. 2, the exterior diameter (O.D.) is constant throughout the length of the post 54, including at an upper end 56.

Figure 8:
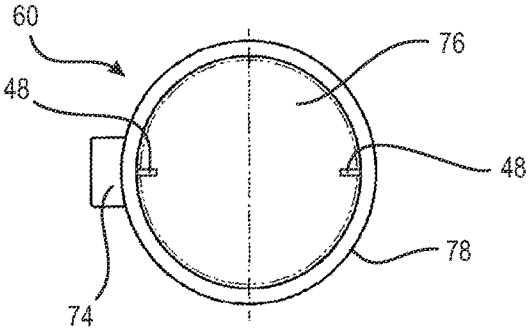
FIG. 8 is a bottom view of the present eye top cap.
Figure 9:
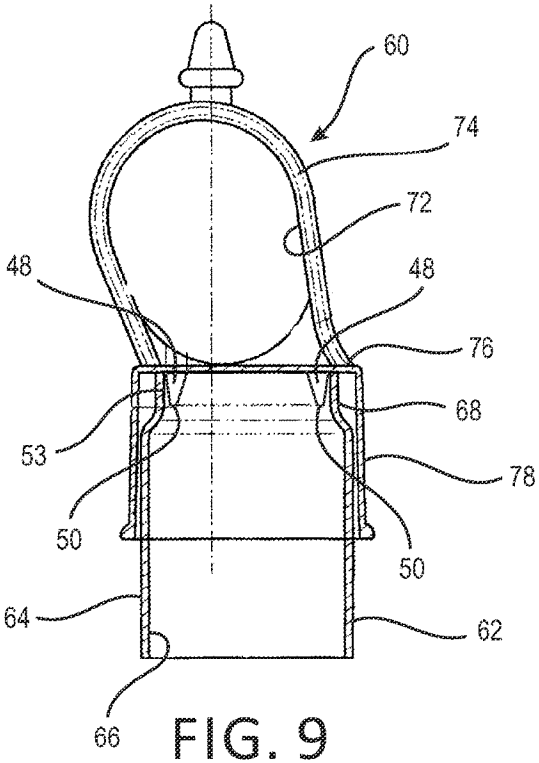
FIG. 9 is a vertical cross-section of the assembled cap and post of FIG. 7.
Figure 7:
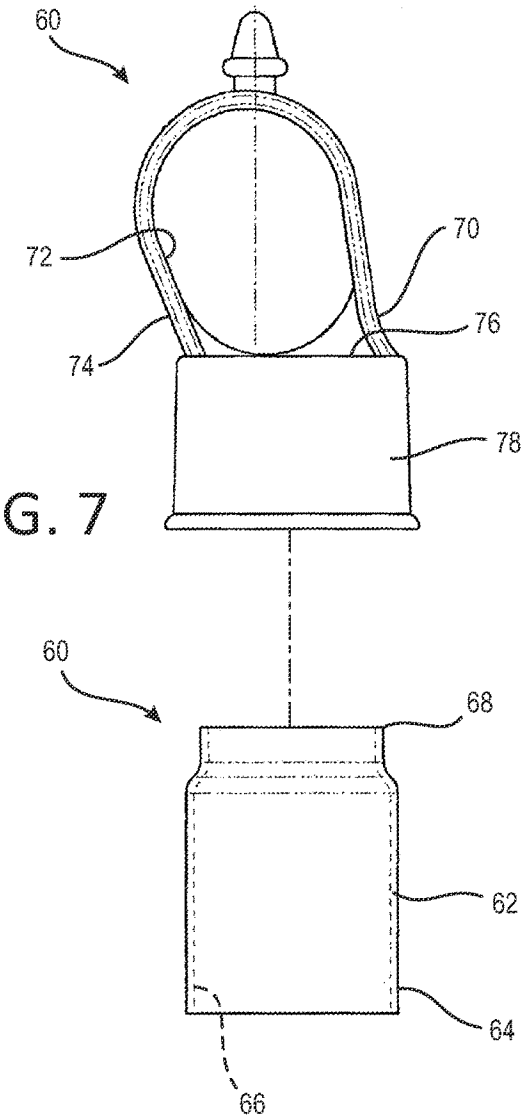
FIG. 7 is an exploded front view of the present chain link line fence post and present eye top cap.

Referring now to FIGS. 7-9, an alternate embodiment to the present chain link assembly 30 is generally designated 60. A line post 62 has an outer surface 64, and inner surface 66 and a crimped or chamfered upper end 68 which has a smaller diameter than the remainder of the post. A main difference between the two embodiments 30 and 60, besides the main diameter of the line post 62, which is 1⅝ inches as described above, is in the configuration of an eye top or line post cap 70. The eye top cap 70, which is preferably made of cast aluminum or the like as an integral component, has an opening 72 defined by a loop 74 for slidingly accommodating the top rail 22. Also, the eye top cap 70 has a top end 76 that is generally planar and horizontally-oriented, however other configurations and shapes are contemplated.

Like the terminal post cap 40, the line post eye top cap 70 has at least one and preferably a pair of depending tabs 48, each with a tip 40 pointing away from the top end 74. The tab 48 in the eye top cap 70 is dimensioned and configured similarly to the tab 48 in the terminal post cap 40. An edge 53 also engages the inner surface 66 of the line post 62 in a friction fit as described above in relation to the terminal post cap 40. The cap 70 also has an annular skirt 78 than envelops the outer surface 64 of the line post 62.

Referring now to FIG. 9, through the use of the tabs 48, the eye top cap 70 more effectively engages the line post 62 than conventional chain link fence assemblies. Also, the crimped upper end 68 of the post 62 facilitates positive engagement between the cap 70 and the post 62, with the post extending further into the cap than conventional assemblies. The line post 62 extends into the eye top cap 70 approximately 1¼ inch. As seen in FIG. 9, the line post 62 contacts an underside of the top end 76.

Referring now to FIGS. 10-12, an alternate embodiment to the chain link fence assembly 30 is generally designated 80. Components shared between the assemblies 30 and 80 are designated with identical reference numbers. One distinctive feature of the assembly 80 is that an upper end 82 of the post 34 is crimped to have an annular groove 84 which is recessed radially from the outer surface 36. The annular groove 84 is located slightly below the post upper edge to create an outwardly flared upper post edge 86 which is slightly angled or inclined relative to the post outer surface 36. In the act of creating the annular groove 84, the flared edge 86 is provided with a slightly larger diameter than the post outer surface 36. This increases the holding or gripping power between the post 34 and the cap 40.

Referring to the cap 40, the formations 48 as tabs seen above are replaced by a plurality of depending lugs 88. In the preferred embodiment, there are three such lugs 88, being generally equidistantly spaced around the cap interior surface 44, preferably at 120° apart from each other in relation to the circular shape of the cap. It is contemplated that the angular spacing may vary to suit the application. Each of the depending lugs 88 is constructed and arranged for being engaged by the flared upper post edge 86. In a preferred embodiment, the depending lugs 88 have a convex exterior that is complementary to the flared outer edge 86. It has been found that the use of the three lugs 88 enhances the alignment of the cap 40 on the post 34.

Referring now to FIGS. 13-15, an alternate embodiment to the present eye top chain link fence assembly 60 is generally designated 90. Components shared between the assemblies 60 and 90 are designated with identical reference numbers. A main distinction between the assemblies 60 and 90 is that in the latter features the post 62 with the annular groove 84 creating the outwardly flared upper edge 86. Since it is contemplated that the eye top caps 70 are commonly slightly pivoted about the line post 62 to be properly aligned for slidingly receiving the top rail 22, it is not uncommon for conventional eye top caps to be relatively looser on the line posts than other types of fence post caps. In the present fence assembly 90, the use of the outwardly flared edge 86 on the post 62 slightly increases the diameter of the post 62, and creates a tighter engagement with the eye top cap 70, more specifically with an interior 92 of the cap skirt 78. In the assembly 90, the eye top cap 70 preferably lacks the formations 48.

While a particular embodiment of the present post and cap for chain link fence with enhanced engagement has been described herein, it will be appreciated by those skilled in the art that changes and modifications may be made thereto without departing from the invention in its broader aspects and as set forth in the following claims.

The invention claimed is:

1. A post and cap assembly for chain link fence, comprising:

a tubular post extending along a longitudinal axis and having a main portion and an upper end;

said main portion of said tubular post extending in a direction parallel to said axis and having a first outer diameter, said post upper end extending parallel to said longitudinal axis and having a second outer diameter smaller than said first outer diameter, and an intermediate interface between said main portion and said post upper end defined by a first crimp and a second crimp;

a cap dimensioned for telescoping engagement with said upper end, said cap having an exterior surface, an interior surface and a depending skirt;

at least one depending formation extending from said interior surface for said post upper end, as said skirt engages an outer surface of said main portion;

wherein said upper end of said tubular post is configured for accommodating said at least one depending formation.

2. The assembly of claim 1, wherein each said depending formation is a tab with a tip engaging said crimped upper end on said inner surface.

3. The assembly of claim 2, further including a pair of said depending formations, configured as tabs located diametrically opposite each other.

4. The assembly of claim 3, wherein each said at least one depending tab is generally triangular in shape, and having a pointed tip at a free end.

5. The assembly of claim 1, wherein said cap is a line post cap with a loop extending above a top end of said cap.

6. The assembly of claim 5, wherein said at least one formation is a pair of tabs depending from said top end of said cap.

7. A post and cap assembly for chain link fence, comprising:

a tubular post with extending along a longitudinal axis and having an upper end and a main portion;

an outer surface of said main portion extends in a direction parallel to said axis, said upper end having a narrowed outer diameter relative to said outer surface of said main portion extending parallel to said longitudinal axis and to said main portion;

the upper end of the tubular post is crimped;

a cap dimensioned for telescoping engagement with the upper end, the cap having an exterior surface, an interior surface and a depending skirt, and at least two depending tabs extending from the interior surface for engaging the upper end as the skirt engages the outer surface of said main portion;

a pair of the depending tabs is located diametrically opposite each other, each depending tab of the at least two depending tabs is generally triangular in shape, and has a pointed tip at a free end, the pointed tip engaging the inner surface at the crimped upper end.

8. The assembly of claim 7, wherein said cap is an eye top cap having a loop that extends above said cap, and the loop defines an opening configured for slidingly accommodating a top rail, said eye top cap loop is oriented at an acute angle relative to the longitudinal axis of said post.

9. A post and cap assembly for chain link fence, comprising:

a tubular post extending along a longitudinal axis and having an upper end and a main portion;

an outer surface of said main portion extends in a direction parallel to said axis;

said upper end having a narrowed outer diameter relative to said outer surface of said main portion extending parallel to said longitudinal axis and to said main portion;

a cap dimensioned for telescoping engagement with said upper end, said cap having an exterior surface, an interior surface and a depending skirt;

at least one depending formation extending from said interior surface for engaging said post upper end, as said skirt engages said main portion; and wherein said upper end of said tubular post is configured for accommodating said at least one depending formation;

the cap is an eye top cap having a loop that extends above said cap, and the loop defines an opening for slidingly accommodating a top rail; and the loop is oriented at an acute angle relative to the longitudinal axis of said post.

10. The assembly of claim 9, wherein said depending tabs increase in width moving away from said pointed tip that engages said inner surface of said crimped upper end.

11. The assembly of claim 9, wherein said crimped upper end of said tubular post positively engages said cap; said triangular shape of the depending tabs tightly engage said inner surface of said crimped upper end as said depending tab widens; and said cap defines a space between said tabs and said skirt, which narrows towards the top of the cap.

* * * * *